US006058844A

United States Patent [19]

Niemiec

[11] Patent Number: 6,058,844

[45] Date of Patent: May 9, 2000

[54] METHOD FOR MINIMIZING WEB-FLUTING IN HEAT-SET, WEB-OFFSET PRINTING PRESSES

[75] Inventor: James P. Niemiec, Wisconsin Rapids, Wis.

[73] Assignee: Consolidated Papers, Inc., Wisconsin Rapids, Wis.

[21] Appl. No.: 09/138,122

[22] Filed: Aug. 21, 1998

Related U.S. Application Data

[63] Continuation-in-part of application No. 08/697,951, Sep. 4, 1996.

[51] Int. Cl.[7] ..... B41F 23/04; B65H 23/00

[52] U.S. Cl. ..... 101/488; 101/424.1; 101/DIG. 42; 242/615; 242/615.2; 226/190

[58] Field of Search ..... 101/488, DIG. 42, 101/424.1; 242/615, 615.2; 226/190; 492/21, 27, 39, 47

[56] References Cited

U.S. PATENT DOCUMENTS

| | | | |
|---|---|---|---|
| 3,387,448 | 6/1968 | Lathem et al. | 26/99 |
| 3,442,211 | 5/1969 | Beacham | 101/416 |
| 3,545,054 | 12/1970 | Sando et al. | 26/105 |
| 3,912,188 | 10/1975 | Ballard | 242/75.2 |
| 4,038,917 | 8/1977 | DeLigt | 101/23 |

(List continued on next page.)

FOREIGN PATENT DOCUMENTS

| | | | |
|---|---|---|---|
| 2054343 | 4/1992 | Canada . | |
| 3022557 | 1/1982 | Germany | 101/424.1 |

OTHER PUBLICATIONS

Technical Association of the Graphic Arts, Rochester, New York, 1982 Proceedings, pp. 483–496, especially p. 494, Fig. 8.

"Tension Wrinkling and the Fluting of Light Weight Coated Papers in Web–Offset Printing", C.C. Habeger, Journal of Pulp and Paper Science, vol. 19, No. 5, Sep. 1993, pp. 1214–1218.

"Problem: Solvent Condensation Streaking", Hurletron (References U.S. Pat. 5,275,103).

"The Mount Hope Roll Book", Mt. Hope Machinery Co., Taunton, Mass., Sep. 1980.

"Principles of the Mount Hope Roll". Mt. Hope Machinery Co., Taunton, Mass.

GATF Article on "Web Offset Press Operating", pp. 160–161.

"Predicting the Fluting Tendency of Light Weight Coated Papers", T.G. Waech and D.H. Sze, TAPPI Proceedings, 1996 International Printing & Graphic Arts Conference, pp. 65–73.

*Primary Examiner*—John S. Hilten
*Assistant Examiner*—Leslie J. Grohusky
*Attorney, Agent, or Firm*—Juetiner Pyle & Piontek

[57] ABSTRACT

A method of and apparatus for minimizing the problem of "fluting" or "corrugating" occuring in printed webs of light weight coated paper printed on both sides with thermosetting ink on heat-set web-offset printing presses resides in spreading the web in its width-wise direction as the printed web exits from the ink drying and heat setting oven of the press and passes over the web cooling chill rolls downstream from the oven, thereby to hold the printed web in a flat and smooth condition until it is cooled and the ink has taken a permanent set. Spreading the web prior to and during cooling allows the inks to thermoset in a flat state because the web is kept flat and free of flutes during thermosetting of the inks. The method and apparatus facilitate operation of the press at higher speeds and with lighter grades of paper than conventional, and provide for increased production efficiencies, lower costs, enhanced print quality, and access to new markets for web-offset printing.

9 Claims, 1 Drawing Sheet

U.S. PATENT DOCUMENTS

| | | | |
|---|---|---|---|
| 4,462,169 | 7/1984 | Daane | 34/62 |
| 4,611,479 | 9/1986 | Guttinger | 72/16 |
| 4,817,995 | 4/1989 | Deubler et al. | 285/98 |
| 4,928,997 | 5/1990 | Reisener et al. | 285/13 |
| 4,976,282 | 12/1990 | Kubala | 137/580 |
| 5,005,778 | 4/1991 | Gladish | 242/61 |
| 5,108,531 | 4/1992 | Quadracci | 156/277 |
| 5,184,555 | 2/1993 | Quadracci et al. | 101/424.1 |
| 5,275,103 | 1/1994 | Hahne | 101/488 |
| 5,285,726 | 2/1994 | Ohta | 101/DIG. 42 |
| 5,318,670 | 6/1994 | Link et al. | 162/206 |
| 5,522,785 | 6/1996 | Kedl et al. | 492/21 |
| 5,606,914 | 3/1997 | Borgardt | 101/488 |
| 5,626,944 | 5/1997 | Rasmussen | 428/172 |

METHOD FOR MINIMIZING WEB-FLUTING IN HEAT-SET, WEB-OFFSET PRINTING PRESSES

This is a continuation-in-part of copending application Ser. No. 08/697,951 filed on Sep. 4, 1996.

FIELD OF THE INVENTION

The present invention relates to web-offset printing presses of the type including an oven for heat setting or curing ink applied to both surfaces of a web of paper and one or more chill rolls downstream from the oven for cooling the heated web before further processing of the printed web. The invention is, in particular, concerned with minimizing or curing defects in the printed web known as "fluting" or "corrugating".

BACKGROUND

In high speed web-offset printing presses, ink is applied to both surfaces of the web substantially simultaneously and the ink must be dried before the web can be brought into contact with a solid surface. To dry the ink, the printed or coated web is passed through a float or floater type oven wherein the web is held under tension and floated between cushions of hot air while the ink is being dried. Upon leaving the oven, the web must be cooled before further processing, for example, sheeting, folding or rewinding. For the purpose, the web upon exiting the oven is passed over one or more chill drums or rolls, i.e., internally cooled drums, which reduce the web temperature from about 200° F. to about 90° F.

In moving the printed web through the oven, it is necessary to maintain the web under lengthwise or machine direction tension in order to cause the web to move through the oven without contacting any of the oven's surfaces. The heat and tension forces applied to the web in the oven cause the paper to contract on itself in the width-wise or cross machine direction, i.e., transversely of the length of the web, in a series of longitudinally extending hills and valleys or corrugations. If these become locked into the printed sheet, due for example to thermosetting of a thermosetting ink and/or a thermosetting coating on the paper, they frequently result in an unacceptable printed product which must be discarded and disposed of as waste.

Fluting is the term most often used to describe the permanent, cross-direction (CD), ridge-and-valley undulations created in light-weight coated (LWC) papers during lithographic web-offset printing. The phenomenon, which has been of practical concern for many years, is also referred to as corrugating, ridging, troughing, and waffling. Flutes are tension wrinkles created in the dryer and locked into the web upon drying of the ink and paper coating. The shapes of these flutes approximate sine waves with wavelengths in the range of 0.5 to 2.0 cm (0.2 to 0.8 inch). A line, drawn along a flute peak (or trough) runs, almost exactly, in the machine direction (MD). These aligned, regularly spaced corrugations detract from the quality of the printed image in a more aesthetically disturbing manner than would randomly distributed deformations of the same amplitude. The flutes form in the oven or dryer section of the web-offset press. Both web tension and above room temperature drying create the flutes. Ink coverage plays an important role; the heavily inked areas are more fluted, especially if they are printed on both sides. Coated papers exhibit severe fluting, and the higher the ratio of coating to fibre basis weight the worse will be the fluting. Light-weight sheets are more at risk; fluting is rarely observed when the basis weight is greater than about 120 grams per square meter (120 g/m$^2$)(80 lbs/per 3300 sq. ft. ream). The wavelength of the flutes increases as sheet basis weight increases. Fluting occurs in hot-air impingement dryers. It does not occur when the ink is cured with ultraviolet radiation.

U.S. Pat. No. 3,442,211, No. 4,462,169 and No. 5,275,103 propose solutions to the problem of streaking of the printed web due to ink solvent condensation on the chill roll or rolls, but they do not address the problem of fluting or corrugating.

German patent publication DE 3022557 discloses a web fed printing machine for offset, gravure and flexographic printing comprising a printing station, a drying station and a cooling station, and including in the cooling station a chill roll having a concave peripheral surface for reducing the formation of folds at the side edges of the web. Folds occur on chill rolls when an excessively slack area in a paper web, usually near its edges, folds over and is pressed in place. This is a random phenomenon, usually corrected by optimum web tensions, and is not to be confused with fluting which is systematic and repetitive in nature.

SUMMARY OF THE INVENTION

It is an object of the invention to provide a method and apparatus for eliminating, or at least minimizing, the problem of fluting in high speed, heat-set, web-offset printing of continuous webs of light weight coated (LWC) papers.

The invention is particularly directed to web offset printing of LWC papers that are coated on both sides with thermosetting coating materials and/or that are printed on both sides with thermosetting inks. Such thermosetting materials when heat-set will lock the flutes into the printed web and will detract from or spoil the aesthetic quality of the printed image. Fluting has for a long time been a serious appearance concern in the printing of LWC papers.

It is a particular object of the invention to provide a method of and apparatus for eliminating fluting in printed LWC papers by stretching or spreading the printed web transversely of its length, in the width-wise or cross machine direction, as it exits from the oven and passes over the chill roll or rolls, so that the printed web is spread out and held flat (a) while the thermosetting ink or coating is still hot and pliable and (b) while the web is being cooled to a set condition, whereby the web is maintained flat and smooth during the time in which flutes or corrugations would otherwise become permanently set in the printed web. Spreading the web prior to and during cooling allows the inks to thermoset in a flat state because the web is flat.

Due to these operational criteria, the invention facilitates the use in heat-set web-offset printing presses of lighter weight coated papers than heretofore deemed feasible, especially those weighing less than 80 pounds per 3300 square foot ream (120 g/m$^2$).

Pursuant to the invention, spreading the web transversely of its length and holding it flat as it exits from the oven and during cooling may be achieved in one of two ways or by a combination of the two. One way is to utilize one or more chill rolls that have a convex or crowned peripheral surface in order to impart a lateral spreading force to the web and to hold the web flat during cooling. Another way is to contact the web with the convex surfaces of bowed spreader rolls located in open web runs between the oven and the chill rolls and/or between the chill rolls to spread the web width-wise and hold it flat during the period of time in which the web is being cooled and takes a permanent set. Such bowed rolls may be used in combination with either conventional cylindrical chill rolls or crowned chill rolls. In either event, the hot web is spread out, tensioned transversely of its length and held flat (a) while the thermosetting materials are hot and pliable, (b) during the time the web temperature is reduced and (c) until the printed web becomes set in a final flat and smooth condition.

The method and apparatus of the invention thus eliminate or drastically minimize the problem of fluting. This in turn provides the advantages that high speed, heat-set, web-offset printing is able to compete with other printing processes, such as rotogravure and sheet-fed offset, where fluting is not a problem. Additionally, the invention facilitates the printing on heat-set web-offset printing presses of much lighter grades of paper than heretofore feasible. All of these factors result in production efficiencies, lower costs, enhanced aesthetic print qualities, and access to new markets for web-offset printing.

These and other objects and advantages of the invention will become apparent from the following detailed description, as considered in conjunction with the accompanying drawings.

IN THE DRAWINGS

DETAILED DESCRIPTION OF PREFERRED EMBODIMENT

The following is a detailed description of preferred embodiments of the invention presently deemed by the inventor to be the best mode of carrying out the invention.

Figure 1:
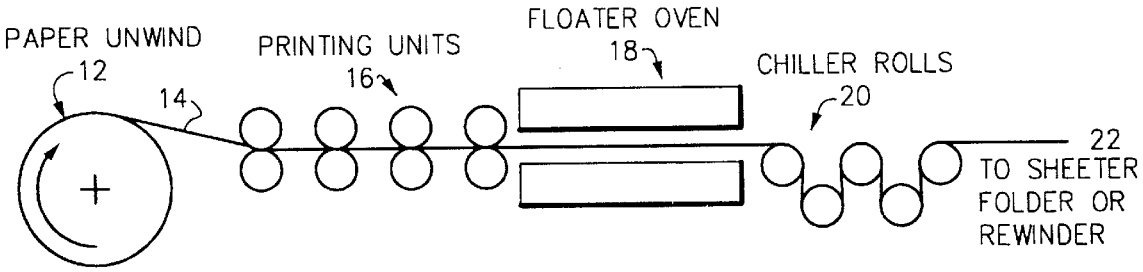
FIG. 1 is a schematic illustration, in side elevation, of a heat-set web-offset printing press employing, in accordance with the invention, one or more smooth surfaced, convex or crowned chill rolls.

Referring to FIG. 1, a heat-set web-offset printing press is schematically illustrated as being comprised of a web unwind station 12 where a web of LWC paper 14 is unwound from a supply roll or reel, a plurality of opposed pairs of printing rollers or cylinders 16 which apply ink to the opposite surfaces of the web, a floater type oven 18 through which the printed web passes without contacting any surfaces in the oven, and a plurality of chill rolls 20 over which the web passes in serpentine fashion for delivery to a further processing unit, such as a sheeter/folder/rewinder station, indicated generically at 22.

As is known, the oven 18 provides a cushion of hot air on both sides of the web in order to "float" the web during its passage through the oven, and the oven 18 serves to evaporate the solvent in the ink, to dry the ink on the web, and to initiate thermosetting of the thermosetting resins that are incorporated in the ink and/or the coating on the paper. Typically, the printed web will have been heated to a temperature of about 200° F. by the time the web exits from the oven.

A plurality of internally cooled chiller drums or chill rolls 20 are provided in sufficient number and size and with peripheral surfaces cooled to a sufficient degree to cool the web down to about 90° F. before the printed web is delivered to station 22 for further processing.

During its passage from the printing cylinders to and through the oven, the web must be maintained under tension so that it moves in an essentially straight line, does not droop or sag, and does not come in contact with any surfaces that might cause smearing of the ink. Under the conditions of high heat and longitudinal (machine direction) tension, the web tends to contract across its width in the cross machine direction. This results in formation in the web of longitudinally extending flutes or corrugations and a consequent undulating or waving surface profile in the cross machine direction. If excessive, the fluting or corrugating results in unacceptable printed product, which must be discarded and disposed of as waste.

Figure 2:
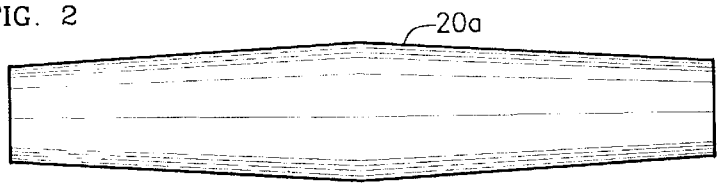
FIG. 2 is a schematic plan view illustration of a crowned or convex chill roll for use in the printing press of FIG. 1.

In the FIG. 1 embodiment of the invention, the problem is cured by utilizing as the first chill roll, and as one or more additional chill rolls, a chill roll 20*a* that has a smooth peripheral surface and a crowned or convex end-to-end configuration as illustrated schematically in FIG. 2. The central portion of the roll is of largest diameter and the roll is tapered from its central portion to each of its ends. By having the central portion of the roll of larger diameter than the ends of the roll, the roll 20*a* causes the web to be spread laterally along the roll from the center of the web to each of the two sides of the web. Also, the roll has a smooth uninterrupted peripheral surface to accommodate lateral spreading of the printed web without causing the ink on the web to be smeared or disrupted, and to hold the web flat after it has been spread. Consequently, as the hot web exits from the oven, it is spread out in the cross machine direction, stretched laterally from its center to each of its side edges, and then held flat while it is being cooled and before it can take a permanent set in the fluted or corrugated condition in which it passed through the oven. Thus, the cooled printed product is flat and smooth, without flutes or corrugations.

Figure 4:
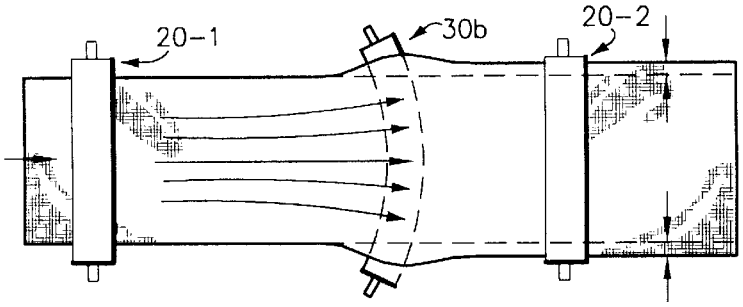
FIG. 4 is a schematic illustration of a typical bowed spreader roll for use in the printing press of FIG. 3.

In practice, once the printing press has been set in operation, and as will become more apparent from FIG. 4, the lateral spreading effect of the crowned or convex chill roll adjacent the exit end of the oven will be imparted to the web at a location upstream from the roll, i.e., in the direction toward the exit end of the oven, and the web will be substantially completely spread out when it actually contacts the first chill roll. The roll itself then holds the web flat in its spread condition. Consequently, the crowned roll does not smear the ink on the web.

Preferably, all of the chill rolls in the FIG. 1 press are of the crowned or convex configuration illustrated at 20*a* in FIG. 2. However, it may not be necessary or desirable in all instances for all of the chill rolls to be crowned or convex. For example, it may suffice to have the first one or two or just certain selected ones of the rolls of the crowned configuration in order to flatten and smooth out the web before it takes a permanent set.

Figure 3:
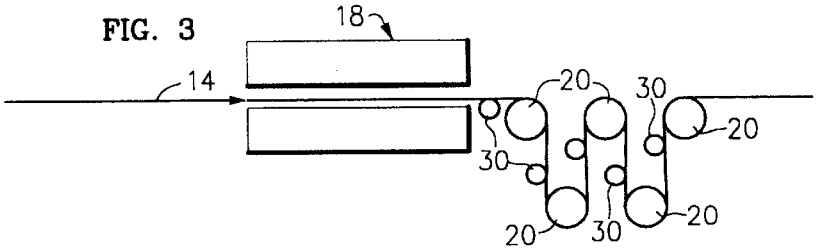
FIG. 3 is a schematic illustration, in side elevation, of the oven and the chill rolls of a heat-set web-offset printing press utilizing, in accordance with the invention, bowed spreader rolls in conjunction with the chill rolls.

As a general rule, it will be preferable to have the first one of the chill rolls, i.e., the roll immediately at the exit end of the oven, crowned or convex, so that the web spreading effect of the roll 20*a* will extend upstream into the interior of the oven and initiate spreading and flattening of the printed web at the earliest possible time. The web is thus spread laterally and held flat (a) while the thermosetting ink or coating is still hot and in a plastic, pliable state, (b) during the time the web is being cooled, and (c) until the ink or coating has become set, so that when the printed web reaches the station 22 it will have taken on a flat and smooth permanent set. Referring to FIG. 3, a second embodiment of the invention is illustrated as being comprised of a plurality of bowed spreader rolls 30 that are used in conjunction with chill rolls 20, which may be conventional cylindrical chill rolls or the crowned or convex chill rolls 20*a* of FIG. 2, or a combination of the two. The rolls 30 in conjunction with the rolls 20, serve to spread the heated web laterally and to hold it flat until the web is cooled and the ink becomes set.

As shown in FIG. 3, in which the illustrated components of the printing press are indicated by the same numerals as employed in FIG. 1, the chill rolls 20 are separated from one another to provide open runs of the web between the oven and the first chill roll 20 and between adjacent ones of the rolls 20 in the sequence in which the rolls are contacted by the web. In the preferred embodiment, a spreader roll 30 is associated with and contacts the web in each of the open runs of the web so that the web is spread out and flattened immediately prior to the web contacting the next succeeding chill drum or roll.

The lead out distance from each of the spreader rolls 30 to the next succeeding chill roll or drum 20 in the direction of web travel should be kept small so that the tendency of the web to return to an unstretched or fluted state will be minimized and the sequence of spreader roll/chill roll will do a better job of locking the web into a spread out and flattened condition rather than a fluted or corrugated condition.

In fully complementary fashion, a longer lead-in distance to each spreader roll affords the spreader roll a longer time and distance within which to perform its work and thus a better opportunity to fully spread and flatten the web. Therefore, as illustrated in FIG. 3, the lead-in distance to each roll 30 is substantially greater than the lead-out distance to the next drum 20.

Referring to FIG. 4, a bowed spreader roll, such as available from Mt. Hope Machinery Co., Taunton, Mass., or Spencer Johnson Co., Appleton, Wis., comprises a roll 30*b* that is symmetrically curved along its longitudinal axis. The roll is of constant diameter along its entire face length and is free turning about a fixed axle. The turning force may be provided by the web that passes over the roll or by a drive sheave mounted on the end of the roll face. The roll consists of a nonrotating axle curved to provide the degree of bow required for a specific application, a series of bearing assemblies mounted on the axle so that their outer races are free to turn, while the inner races are held stationary on the axle, and a flexible rubber sleeve which rotates with the outer races of the ball bearing assemblies. In operation, the sleeve expands as it rotates from the concave side of the curved axle to the convex side. The roll is set so that the web approaches the roll on the concave side and leaves on the convex side, with the web in contact with the convex side. In this way, the web is spread out in the cross machine direction.

The spreading of the web starts when the web leaves a lead in roll, such as the roll 20-1 in FIG. 4, i.e., the roll which is the next roll upstream from the bowed roll 30*b*. As the web leaves the bowed roll, spreading is complete and the web will have a tendency to return or go back to its original state. The closer the bowed roll is to the next roll in the system, e.g., the next succeeding chill roll 20-2, the better the job of locking in the spreading that is accomplished with the bowed roll. As above explained, the lead out distance should be kept short in comparison to the lead in distance.

When the bow is set in its normal position, with the curved axle in a plane generally parallel to the mean path of movement of the web, the web is spread evenly from the center to both side edges of the roll. The distance the web travels at the edges is exactly the same as at the center, thus maximizing uniform spreading from the center to each edge. To correct for baggy centers, the curved axle is rotated to move the bow into the web so that the center travels a slightly further distance than the edges. To correct slack edges, the bow is rotated out of the web so that the edges travel a slightly further distance than the center. In any event, the roll serves to spread out and flatten the web.

The angle of wrap of the web on the roll, i.e., the amount of contact between the web and the roll, is also a factor governing the web spreading effect. Generally, the greater the angle of wrap, the greater the spreading force.

In both of the illustrated embodiments of the invention, the printed web travels from the printing press 16 to the sheeter/folder/rewinder station 22 free of any intervening pressure nips. Nip pressure in the oven or cooling station would smear the pliable ink, distort the printing and detract from print quality. In accordance with the invention, the ink is fully set as the printed web leaves the chill roll station 20 and before it encounters any pressure nips. The tension force on the web that pulls the web from the press to the sheeter/folder/rewinder station is applied solely and entirely from the station alternatively, from some other location downstream from the chill roll station 20.

In all of the embodiments above described, the invention serves to eliminate or cure, or at least significantly reduce, the currently existing problem of "fluting" or "corrugating" of printed webs of LWC paper when printed with thermosetting inks on heat-set, web-offset printing presses.

Consequently, heat-set, web-offset printing of LWC papers may now be performed at high press speeds and will therefore be able to compete effectively with other printing processes, such as rotogravure and sheet-fed offset. Additionally, the invention facilitates printing on heat-set web-offset printing presses of much lighter grades of paper than heretofore feasible. These factors in turn result in production efficiencies, lower costs, enhanced aesthetic print qualities, and access to new markets for web-offset printing.

The objects and advantages of the invention have therefore been shown to be attained in a convenient, practical, economical and facile manner.

While preferred embodiments of the invention have been herein illustrated and described, it is appreciated that various changes, rearrangements and modifications may be made therein without departing from the scope of the invention as defined by the appended claims.

What is claimed is:

1. A process of minimizing fluting in a web of light weight coated paper printed on both sides with thermosetting ink in a heat-set web-offset printing press having a floater type drying oven and one or more chill rolls downstream from the oven for cooling the printed and heated web and including a smooth surfaced chill roll immediately downstream from the oven, comprising the steps of:

pulling the printed web through the oven and the chill rolls free of any intervening pressure nips, contacting the printed web as it passes from the exit end of the oven with a convexly curved surface to spread the web transversely of its length during passage of the web through at least a downstream end portion of the floater oven and during passage of the web from the oven to the chill roll immediately downstream from the oven and contacting the transversely spread printed web with the smooth surface of said chill roll to hold the web in a transversely spread and flat condition during cooling.

2. A process as set forth in claim 1, wherein the two steps of contacting the web as it passes from the exit end of the oven are carried out substantially simultaneously with a chill roll having a smooth and convexly crowned surface for spreading the web transversely of its length and for holding the web in its transversely spread condition.

3. A process as set forth in claim 2, comprising the further step of contacting the web with additional chill rolls having smooth and convexly crowned surfaces for spreading the web transversely of its length and for substantially simultaneously holding the web in transversely spread and flat condition during passage of the web over the chill rolls.

4. A process as set forth in claim 1, wherein the printed web is first contacted in the space between the oven and the chill roll immediately downstream from the oven with a spreader roll having a convex web contacting surface and is then contacted with the smooth surface of said chill roll.

5. A process as set forth in claim 1, wherein the printing press includes a plurality of chill rolls spaced from one another and defining therebetween open runs of the web and wherein the process includes the further step of contacting the web with a convex web spreading surface at one or more of said open runs.

6. In a web off-set printing process comprising the steps of feeding a web of light-weight coated paper to a web off-set printing press, printing both sides of the web with thermosetting ink, passing the printed web through a floater oven wherein the web is supported under tension and by oven air flow without physical contact with any structure, heating the web and drying and thermosetting the ink to at least a plastic state in the oven, delivering the printed web from the oven to a chill roll section, contacting the printed web with a plurality of chill rolls to cool the printed web, passing the printed web from the chill rolls to a sheeter/folder/rewinder station, and applying a pulling force to the web at the sheeter/folder/rewinder station to pull the web under tension from the printing press through the oven and chill roll section to the sheeter/folder/rewinder station free of any intervening pressure nips, the improvement comprising contacting the heated printed web as it exits from the oven with a convexly curved surface for spreading the printed web transversely of its length and for eliminating, before the web is cooled and the ink is fully set, any flutes that may have formed in the printed web during its passage under tension through the oven.

7. A process as set forth in claim 6, wherein the improvement comprises contacting the heated printed web as it exits from the oven with a smooth surfaced and convexly crowned chill roll for spreading the web transversely of its length and for holding the web in its transversely spread condition.

8. A process as set forth in claim 6, wherein the improvement comprises contacting the heated printed web as it exits from the oven with the convexly curved surface of a bowed roll positioned between the oven exit and the first chill roll in the chill roll section for spreading the web transversely of its length, and providing a first chill roll having a smooth surface for holding the web in its transversely spread condition.

9. A process as set forth in claim 6, wherein the chill rolls in the chill roll section are spaced apart and the web has open runs between adjacent chill rolls, and wherein the improvement comprises the further step of contacting the web at one or more of said open runs with a convexly curved surface for spreading the printed web transversely of its length within one or more of the open runs.

* * * * *